United States Patent [19]

Meichsner et al.

[11] Patent Number: 4,832,739

[45] Date of Patent: May 23, 1989

[54] PROCESS FOR DESULFURIZING MOLTEN IRON

[75] Inventors: Walter Meichsner, Krefeld; Werner Gmohling, Hufschlag; Manfred Tutte, Moers; Karl-Heinz Peters, Dinslaken, all of Fed. Rep. of Germany

[73] Assignees: Thyssen Stahl AG, Duisburg; SKW Trostberg AG, Trostberg, both of Fed. Rep. of Germany

[21] Appl. No.: 208,324

[22] Filed: Jun. 17, 1988

Related U.S. Application Data

[63] Continuation-in-part of Ser. No. 942,469, Dec. 16, 1986, Pat. No. 4,764,211.

[30] Foreign Application Priority Data

Dec. 17, 1985 [DE] Fed. Rep. of Germany ..... 3544563
Dec. 17, 1985 [DE] Fed. Rep. of Germany ..... 3544562

[51] Int. Cl.[4] ..... C21C 7/02
[52] U.S. Cl. ..... 75/58; 75/53
[58] Field of Search ..... 75/53, 58

[56] References Cited

U.S. PATENT DOCUMENTS

| | | | |
|---|---|---|---|
| 3,598,573 | 8/1971 | Freissmuth et al. | 75/55 |
| 3,998,625 | 12/1976 | Koros | 75/58 |
| 4,078,915 | 3/1978 | Meichsner et al. | 85/58 |
| 4,159,906 | 7/1979 | Meichsner et al. | 75/58 |
| 4,260,413 | 4/1981 | Freissmuth | 75/58 |
| 4,266,969 | 5/1981 | Koros | 75/58 |
| 4,395,282 | 7/1983 | Braun | 75/58 |
| 4,581,068 | 4/1986 | Schramm | 75/53 |
| 4,592,777 | 6/1986 | Rellermeyer | 75/58 |
| 4,687,512 | 8/1987 | Schrodter | 75/58 |

FOREIGN PATENT DOCUMENTS

| | | |
|---|---|---|
| 1758250 | 4/1968 | Fed. Rep. of Germany . |
| 2252796 | 5/1974 | Fed. Rep. of Germany . |
| 2531047 | 1/1977 | Fed. Rep. of Germany . |
| 1534586 | 12/1978 | United Kingdom . |

*Primary Examiner*—Peter D. Rosenberg
*Attorney, Agent, or Firm*—Sprung Horn Kramer & Woods

[57] ABSTRACT

A process for desulfurizing molten iron using a fine-grain agent consisting essentially of industrial calcium carbide, a dried coal, the coal containing at least 15% by weight of volatile components, and fine-grained magnesium and which agent is injected in fluidized form into an iron melt by means of a gas, comprising separately storing fine-grained magnesium and a calcium carbide/coal mixture, separately fluidizing the fine-grained magnesium and calcium carbide/coal mixture, combining the fluidized fine-grained magnesium and calcium carbide/coal mixture in a conveying line or lance and injecting the resultant combined fluidized mixture into an iron melt.

A process for desulfurizing molten iron using a fine-grain agent consisting essentially of industrial calcium carbide, a dried coal, the coal containing at least 15% by weight of volatile components, and fine-grained magnesium and which agent is injected in fluidized form into an iron melt by means of a gas, comprising separately storing fine-grained magnesium, calcium carbide and coal, separately fluidizing the fine-grained magnesium, the calcium carbide and the coal, combining the fluidized fine-grained magnesium, the calicum carbide and the coal in a conveying line or lance and injecting the resultant combined fluidized mixture into an iron melt.

20 Claims, No Drawings

PROCESS FOR DESULFURIZING MOLTEN IRON

CROSS-REFERENCE TO RELATED APPLICATION

This application is a continuation-in-part application of application Ser. No. 06/942,469, filed Dec. 16, 1986, now U.S. Pat. No. 4,764,211 hereinafter referred to as the "parent application".

BACKGROUND OF THE INVENTION

1. Field of the Invention

The invention relates to a process for desulfurization of iron melts outside a blast furnace. Iron melts here are taken to mean pig iron and cast iron melts.

2. Background Information

The desulfurization of pig iron, outside a blast furnace, in a torpedo or open ladle is now part of the state of the art. Mixtures based on calcium carbide have prevailed as the preferred desulfurization agent, since these cause rapid desulfurization of a pig iron, along with high economy, and lead to low final sulfur contents. A particularly preferred agent is represented by a mixture comprising 20 to 90% by weight of industrial calcium carbide and calcium carbonate, preferably in precipitated form, and 2 to 20% by weight of carbon distributed therein, the fine-grain calcium carbonate/-carbon mixture being known under the name "diamide lime" (German Pat. No. 1,758,250).

German Auslegeschrift No. 2,531,047 has disclosed a process for desulfurizing pig iron, wherein a mixture of calcium carbide, calcium cyanamide or lime containing a proportion of 0.5 to 3.5% by weight of aluminum or magnesium powder, relative to the calcium compounds, is used as the desulfurizing agent.

In U.S. Pat. No. 3,998,625, a desulfurizing agent consisting of a combination of lime and further constituents with magnesium is described, and the use of lime with a carbonaceous material and a non-oxidizing carrier gas is recommended in U.S. Pat. No. 4,266,969.

The disadvantage of the known agents are the large quantities of slag which are obtained and which lead to undesirable deposits and incrustations, particularly in the torpedo ladles and also in open ladles, and in addition enclose considerable quantities of iron, which causes considerable losses of iron.

It has also already been proposed that, in place of calcium carbonate, an additive be added to the calcium carbide which generates hydrogen at the temperature of the iron melt (German Pat. No. 2,252,796). However, such a desulfurization agent has not proven itself in practice, since the generation of hydrogen obviously does not occur in such a fashion such that an adequate dispersion of the calcium carbide in the iron melt could be effected.

It has been disclosed that calcium carbide can be employed during the treatment of cast iron melts as a desulfurization agent together with carbon, for example, in the form of pitch coke, animal charcoal or leather charcoal, but the types of coal proposed contain virtually no volatile components (see the state of the art indicated in German Pat. No. 1,758,250).

An object of the parent application is to provide a desulfurization agent, based on calcium carbide, which, on the one hand, does not introduce further slag-forming components into the iron melt and, on the other hand, evolves an amount of gas immediately after entry into the iron melt, which is adequate for the dispersion of the calcium carbide. Furthermore, advantageous consumption values, short treatment times and low final sulfur contents should be achieved using such desulfurization agent.

This object is achieved by a fine-grain agent, which is injected into the iron melt in fluidized form by means of a gas, which agent comprises a mixture of industrial calcium carbide and a dried coal which contains at least 15% by weight of volatile components and magnesium.

SUMMARY OF THE INVENTION

An object of the present application is to provide a desulfurization process on the basis of the agent of the parent application, however, without premixing the components thereof.

This object is achieved by separately storing and fluidizing the carbide/coal-mixture and the fine-grained magnesium and by combining the fluidized fine-grained magnesium and carbide/coal mixture in a conveying line or lance and injecting the resultant combined fluidized mixture into an iron melt.

This object is also achieved by separately storing and fluidizing fine-grained magnesium, calcium carbide and coal, and by combining the fluidized fine-grained magnesium, the calcium carbide and the coal in a conveying line or lance and injecting the resultant combined fluidized mixture in an iron melt.

DETAILED DESCRIPTION OF THE INVENTION

In a process according to the invention the carbide/-coal mixture will be prepared by mixing industrial calcium carbide, which contains 65 to 85% by weight of $CaC_2$, with a dried coal containing at least 15% by weight of volatile components. This carbide/coal mixture is stored and fluidized in a so-called dispenser. In a separate dispenser the magnesium is stored and fluidized.

The two constituents are combined in the conveying line or in the lance and hence injected together into the melt.

A process according to the invention comprises injecting the two constituents after combining them by means of a carrier gas at a rate of 3 to 30 standard liters/kg of agent to a level as deep as possible into the molten iron. The feed rate of the agent should amount to 10 to 100 kg/minute; preferably, the feed rate used is 30 to 80 kg/minute of desulfurizing agent.

The carrier gases used for the desulfurizing agent are preferably non-oxidizing gases, such as argon or nitrogen alone or as a mixture.

Preferably the coal used contains at least 25% by weight of volatile constituents which immediately after being injected into the molten iron, releases at least 80 standard liters of gas per kg of coal. Coals which meet these conditions are especially lignites, flame coal, gas flame coal, gas coal and coking-coal. The coals are tabulated below:

TABLE 1

| Coal Type | Volatile Components % | Amount of Gas Evolved (l/kg) | Duration of Gas Evolution (seconds) |
|---|---|---|---|
| Soft Lignite | 50–60 | 450–550 | 7 |
| Hard Lignite | 45–50 | 375–450 | 8 |
| Flame Coal | 40–50 | 350–450 | 30 |
| Gas-Flame-Coal | 35–40 | 275–350 | 30 |

TABLE 1-continued

| Coal Type | Volatile Components % | Amount of Gas Evolved (l/kg) | Duration of Gas Evolution (seconds) |
|---|---|---|---|
| Gas Coal | 28–35 | 200–275 | 40 |

The volatile components specified in Table 1 above for the various types of coal were taken from *Römpps Chemie-Lexikon,* 8th Edition, 1983, Vol. 3, page 2142.

The amount of gas evolved in 1/kg is that amount of gas which escapes on very rapid heating of the coal to the pig iron temperature.

The duration of gas evolution indicates the time (seconds) taken for about 90% of the total amount of gas to be evolved.

If it should prove expedient, two or more coal grades with high contents of volatile constituents can also be used as a mixture.

The moisture content of the dried coal should be less than 0.5% by weight in order to prevent formation of acetylene by reaction with the calcium carbide. Such levels of drying are achieved in commercially available drying equipment, such as helical dryers, fluid-bed dryers or mill-dryers, and on drying in vacuo in simple equipment, wherein the material which is to be dried is merely moved or turned over.

The calcium carbide and the dried coal are grinded and mixed intensively; they are grinded to such an extent that at least 90% by weight of the mixture has a grain size of <200 μm, and preferably 90% by weight has a grain size of <100 μm and 40 to 65% by weight has a grain size of <50 μm. Certain deviations from these figures are immaterial to the desulfurization effect.

It may be advantageous to add to the mixture of calcium carbide and coal 1 to 10% by weight of fluorspar, e.g., to improve the properties of the slag which orginates during the desulfurization. The mixture contains preferably 2 to 6% by weight of fluorspar. Fluorspar may be replaced by aluminum oxide, as alumina or aluminum dross containing up to 30% metallic aluminum, or by alkaline materials, such as soda ash.

The magnesium to be used has a grain size of less than 1 mm. Preferably, a magnesium is used which has already been grinded to <500 μm, and a magnesium having a grain size of <350 μm is particularly preferred.

The magnesium component may be any commercially available product such as:

-pure magnesium,
-magnesium alloys,
-magnesium scraps, or
-coated magnesium granulates.

The advantage of the invention is the generation of a nonoxidizing gas in combination with the variation of the different constituents according to the operation conditions and the final sulfur-content of the melt. That means, that in case of a low desulfurization degree ($\Delta S/S_I$) only a small amount of magnesium or no magnesium at all may be injected, whereas in case of a high desulfurization degree more magnesium may be used to meet time constraints. In either case the high-volatile coal insures a high utilization efficiency of the desulfurization materials.

Preferably the proportion of magnesium is varied during the injection; for example a few minutes before the end of the desulfurization treatment of the melt the flow of the magnesium is discontinued, while the flow of the carbide/coal is continued.

The non-limiting examples which follow are intended to explain the invention in more detail.

EXAMPLES

The desulfurization treatments which are shown in the following Table 2 were carried out in open ladles.

The abbreviations used in Table 2 and 3 are defined hereinbelow on page 8.

TABLE 2

Desulfurization in the Open Ladle, Co-Injection of Carbide/Coal and Magnesium

| Example No. | Desulfirizing Agent kg/t PI Carbide/Coal | Mg | ε | Carbide/Coal / Magnesium | Quality of PI t | $S_I$ % | $S_E$ × $10^{-3}$ | Δ $S/S_I$ % | α | Treatment Time (min) of the Desulfurization |
|---|---|---|---|---|---|---|---|---|---|---|
| 1 | 1.78 | 0.26 | 2.04 | 6.7:1 | 146 | 34 | 8 | 76.4 | 0.78 | 5 |
| 2 | 2.86 | 0.15 | 3.01 | 19:1 | 217 | 19 | 3 | 84.2 | 1.88 | 12.1 |
| 3 | 2.07 | 0.23 | 2.30 | 9:1 | 222 | 20 | 2 | 90.0 | 1.28 | 10.6 |
| 4 | 1.77 | 0.31 | 2.09 | 5.7:1 | 220 | 18 | 2 | 88.8 | 1.30 | 11.6 |
| 5 | 1.56 | 0.39 | 1.95 | 4:1 | 227 | 21 | 3 | 85.7 | 1.08 | 13.4 |
| 6 | 1.10 | 0.31 | 1.41 | 3.5:1 | 165 | 40 | 8 | 80.0 | 0.44 | 7 |
| 7 | 1.24 | 0.27 | 1.51 | 4.6:1 | 165 | 40 | 8 | 80.0 | 0.47 | 7 |
| 8 | 1.43 | 0.24 | 1.67 | 6:1 | 165 | 40 | 8 | 80.0 | 0.52 | 7.2 |

Example No. 1: Carbide/Coal: 94% Calcium Carbide
6% Lignite

Example Nos. 2 to 8: Carbide/Coal: 95% Calcium Carbide
5% Flame Coal

Example Nos. 1 to 8: The magnesium injection was discontinued 2 to 4 minutes before the end of the desulfurization treatment.

| | |
|---|---|
| desulfurizing agent kg/t PI | quantity of desulfurizing agent injected per t (ton) of pig iron. |
| carbide | industrial calcium carbide |
| carbide/coal | mixture of industrial calcium carbide with dried coal |
| carbide/coal/magnesium | mixture of industrial calcium carbide, dried coal and magnesium |
| Mg | magnesium |
| ε | sum of carbide/coal and Mg respect sum of carbide/coal and carbide/coal/magnesium |
| carbide/coal / magnesium | relationship between carbide/coal and magnesium |
| quantity of PI t | quantity of pig iron in t (ton) |
| $S_I$ | initial sulfur conent of the molten pig iron |

TABLE 2-continued

| | |
|---|---|
| $S_E$ | end sulfur content of the molten pig iron |
| $\frac{\Delta S}{S_I}$ | desulfurizing degree |
| α-value | coefficient for the effectiveness of the desulfurizing agent (quotient of injected quantity of desulfurizing agent and difference between the initial and end sulfur contents of the molten pig iron × 100) |
| % | percent by weight |

Instead of coinjecting a carbide/coal-mixture together with magnesium, it is also possible to coinject the carbide/coal-mixture with a premixed carbide/coal/magnesium-mixture.

It is advantagous to continue the injection of the carbide/coal-mixture after stopping the injection of the carbide/coal/magnesium-mixture.

The desulfurization treatment which are shown in the following Table 3 were carried out in open ladles.

TABLE 3

| | Desulfurization in the Open Ladle, Injection of Carbide/Coal and Carbide/Coal/Magnesium-Mixture | | | | |
|---|---|---|---|---|---|
| | Desulfurizing Agent kg/t PI | | | | Magnesium in the Mixture |
| Example No. | Carbide/Coal | Carbide/Coal/Magnesium | ε | Carbide/Coal / Magnesium | % |
| 9 | 3.76 | 0 | 3.76 | — | 0 |
| 10 | 2.58 | 0.42 | 3.00 | 34.7:1 | 2.8 |
| 11 | 2.39 | 0.53 | 2.92 | 26.5:1 | 3.6 |
| 12 | 2.13 | 0.75 | 2.88 | 18.2:1 | 5.2 |
| 13 | 0 | 1.81 | 1.81 | — | 20 |

Carbide/Coal: 95% Calcium Carbide, 5% Flame Coal
Carbide/Coal/Magnesium: 20% Mg, 75% Calcium Carbide, 5% Flame Coal
$S_I = 0.040\%$
$\Delta S/S_I = 80\%$
$S_E = 0.008\%$
Pig Iron Quantity = 220 t
T = 1350° C.

Example Nos. 9 to 13: The injection of the carbide/coal/magnesium mixture was discontinued 2 to 4 minutes before the end of the desulfurization treatment.

It may be advantagous to separately store and separately fluidize fine-grained magnesium, carbide and coal in three dispensers and combine them in a conveying line or lance and inject the resultant combined fluidized mixture into an iron melt.

The content of one or two of the components of the resultant mixture can be varied during the injection.

A further variation of the process consists of sequential injection of the different components with overlapping periods of coinjection.

It will be appreciated that the instant specification and claims are set forth by way of illustration and not limitation, and that various modifications and changes may be made without departing from the spirit and scope of the present invention.

What is claimed is:

1. A process for desulfurizing molten iron using a fine-grain agent consisting essentially of industrial calcium carbide, a dried coal, said coal containing at least 15% by weight of volatile components, and fine-grained magnesium and which agent is injected in fluidized form into an iron melt by means of a gas, comprising separately storing fine-grained magnesium and a calcium carbide/coal mixture, separately fluidizing the fine-grained magnesium and calcium carbide/coal mixture, combining the fluidized fine-grained magnesium and calcium carbide/coal mixture in a conveying line or lance and injecting the resultant combined fluidized mixture into an iron melt.

2. A process as claimed in claim 1, wherein the magnesium content of the resultant mixture is varied during the injection.

3. A process as claimed in claim 1, wherein the injection of the calcium carbide/coal mixture is continued after the end of the injection of the magnesium.

4. A process as claimed in claim 1, wherein the coal releases at least 90 standard liters of gas per kg of coal.

5. A process as claimed in claim 1, wherein the coal has a moisture content of less than 0.5% by weight.

6. A process as claimed in claim 1, wherein the coal is selected from the group consisting of hard lignite, soft lignite, flame coal, gas flame coal, gas coal and coking-coal.

7. A process as claimed in claim 1, wherein the industrial calcium carbide contains 65 to 85% by weight of $CaC_2$.

8. A process as claimed in claim 1, wherein the agent is fed at a feed rate of 10 to 100 kg/minute.

9. A process as claimed in claim 1, wherein the agent is fed at a feed rate of 30 to 80 kg/minute.

10. A process as claimed in claim 1, wherein the injection is conducted by employing a carrier gas at a rate of 3 to 30 standard liters/kg of agent.

11. A process for desulfurizing molten iron using a fine-grain agent consisting essentially of industrial calcium carbide, a dried coal, said coal containing at least 15% by weight of volatile components, and fine-grained magnesium and which agent is injected in fluidized form into an iron melt by means of a gas, comprising separately storing fine-grained magnesium, calcium carbide and coal, separately fluidizing the fine-grained magnesium, the calcium carbide and the coal, combining the fluidized fine-grained magnesium, the calcium carbide and the coal in a conveying line or lance and injecting the resultant combined fluidized mixture into an iron melt.

12. A process as claimed in claim 11, wherein the magnesium content of the resultant mixture is varied during injection.

13. A process as claimed in claim 11, wherein the calcium carbide content of the resultant mixture is varied during injection.

14. A process as claimed in claim 11, wherein the coal releases at least 80 standard liters of gas per kg of coal.

15. A process as claimed in claim 11, wherein the coal has a moisture content of less than 0.5% by weight.

16. A process as claimed in claim 11, wherein the coal is selected from the group consisting of hard lignite, soft lignite, flame coal, gas flame coal and coking-coal.

17. A process as claimed in claim 11, wherein the industrial calcium carbide contains 65 to 85% by weight of $CaC_2$.

18. A process as claimed in claim 11, wherein the agent is fed at a feed rate of 10 to 100 kg/minute.

19. A process as claimed in claim 11, wherein the agent is fed at a feed rate of 30 to 80 kg/minute.

20. A process as claimed in claim 11, wherein the injection is conducted by employing a carrier gas at a rate of 3 to 30 standard liters/kg of agent.

* * * * *